United States Patent [19]

Beck

[11] 4,385,953

[45] May 31, 1983

[54] HAZARDOUS WASTE TRANSPORT CONTAINER LINER AND PROCESS FOR MANUFACTURING SAME

[76] Inventor: William C. Beck, 12717 Pecos Ave., Greenwell Springs, La. 70739

[21] Appl. No.: 331,590

[22] Filed: Dec. 17, 1981

[51] Int. Cl.[3] ..... B31F 1/00

[52] U.S. Cl. ..... 156/200; 156/201; 156/204; 156/227; 156/244.13; 156/250; 156/259; 493/93; 493/94

[58] Field of Search ..... 493/91, 92, 93, 94, 493/95, 96, 97, 98, 99, 100, 101; 156/287, 204, 256, 308.4, 227, 200, 201, 244.13, 244.18, 251, 259

[56] References Cited

U.S. PATENT DOCUMENTS

| | | | |
|---|---|---|---|
| 977,698 | 12/1910 | Barksdale | 493/93 |
| 2,216,527 | 10/1940 | Weiss et al. | 493/96 |
| 2,524,584 | 10/1950 | Zehr | 156/204 |
| 2,809,143 | 10/1957 | Carlson | 156/227 |
| 2,998,340 | 8/1961 | Conway et al. | 493/100 |
| 3,306,328 | 2/1967 | Markus | 156/227 |
| 3,459,357 | 8/1969 | Egger et al. | 493/96 |
| 3,539,360 | 11/1970 | Wood | 493/100 |
| 3,617,418 | 11/1971 | Miller | 156/227 |
| 3,888,163 | 6/1975 | Watanabe | 493/95 |

FOREIGN PATENT DOCUMENTS

| | | | |
|---|---|---|---|
| 1551336 | 8/1979 | United Kingdom | 156/204 |

*Primary Examiner*—Jerome W. Massie
*Assistant Examiner*—Timothy W. Heitbrink
*Attorney, Agent, or Firm*—Roy, Kiesel, Patterson & McKay

[57] ABSTRACT

A process for manufacturing a unique hazardous waste transport container liner is provided wherein an extruded plastic sheet is folded into a "W" shape and heat sealed at one end, then cut to a length to fit the transport container and then heat sealed at the cut end of the sheet.

5 Claims, 7 Drawing Figures

HAZARDOUS WASTE TRANSPORT CONTAINER LINER AND PROCESS FOR MANUFACTURING SAME

BACKGROUND OF THE INVENTION

1. Field of the Invention

This invention relates in general to plastic liners and processes for manufacturing same, and more particularly to processes for manufacturing liners for use in hazardous waste transport containers and processes for manufacturing same.

2. Prior Art

It is common practice today to transport hazardous waste such as a semi-solid material known as sludge in large rectangular steel containers known as Roll Up Boxes as well as large dump trailers. Unfortunately, there is a greater incident of faulty rubber seals used in these containers than desired which results in leaky containers. Another difficulty is the tendency of the sludge to stick to the containers during dumping of the sludge from the container. Thus, complete removal of the sludge from the containers has become a difficult, time consuming operation.

SUMMARY OF THE INVENTION

Therefore, it is an object of this invention to provide a liner for use with Roll Up Boxes and dump trailers to prevent leakage and sticking of sludge to the Roll Up Boxes and dump trailers.

Another object of the invention is to provide a process for manufacturing a liner for use with a hazardous waste container to prevent leakage from the container as well as sticking of the hazardous waste to the container during dumping.

Other objects and advantages of this invention shall become apparent from the ensuing description of the invention.

Accordingly, a process for manufacturing a hazardous waste container liner is provided comprising extruding a plastic sheet of pre-determined length, folding the extruded plastic sheet into a "W"-shaped cross-section and heat-sealing both ends of said sheet.

PREFERRED EMBODIMENTS OF THE INVENTION

Figure 1:
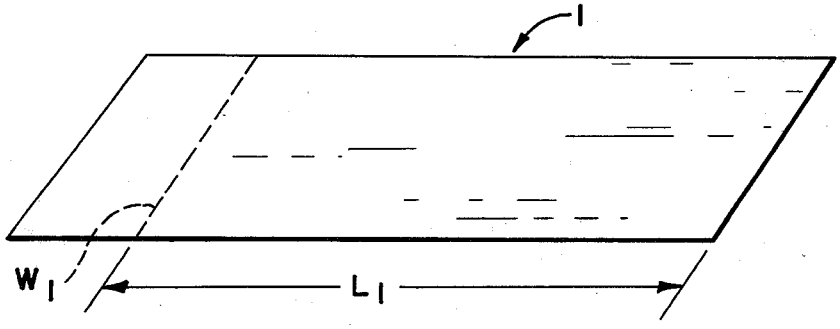
FIG. 1 illustrates an extruded plastic sheet which can be utilized in this invention.
Figure 2:
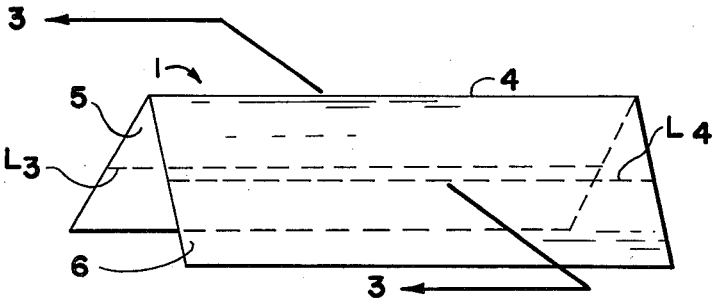
FIGS. 2–5 illustrate a preferred sequence of steps to produce a liner of this invention.
Figure 6:
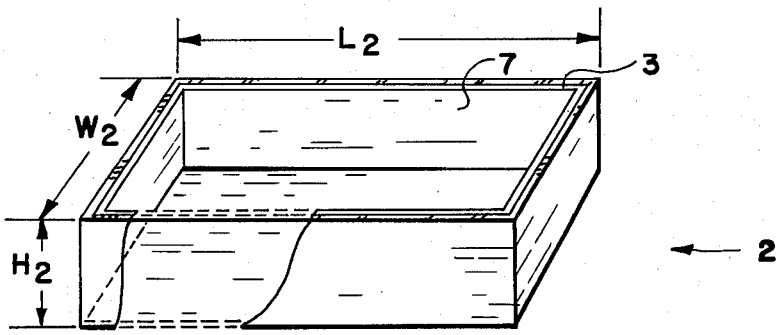
FIG. 6 is a three-dimensional cutaway view of a preferred liner positioned in a Roll Up Box.

Referring now to FIG. 1 and 6 a plastic sheet 1 is extruded and cut along line $W_1$, to produce a sheet having length $L_1$, which is preferably at least one inch longer than the combined length $L_2$ plus twice width $W_2$ of the hazardous waste container 2.

It is preferred that the line $W_1$, be a length at least equal to the width $W_2$ of container 2 plus twice the depth $H_2$ of container so that the liner formed as explained below will be longer and wider than the container and therefore fit flushly against container sides 3.

Figure 3:
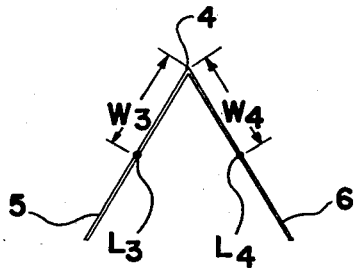
Figure 4:
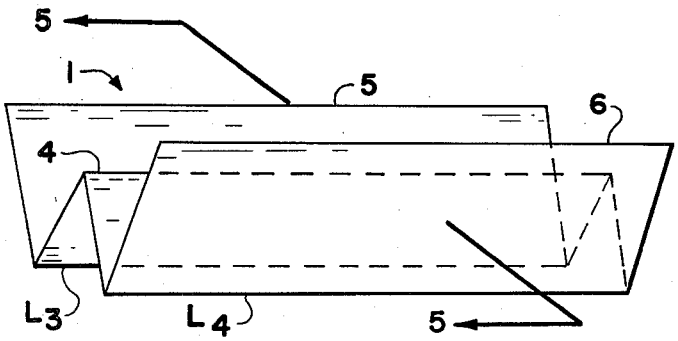
Figure 5:
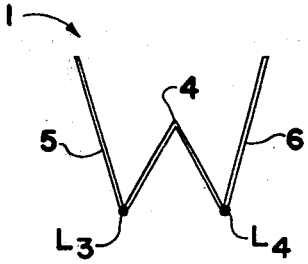

Turning now to FIGS. 2–5 a preferred sequence of steps for manufacturing a preferred liner is illustrated. In this embodiment sheet 1 is folded lengthwise down its centerline 4 to form equal sized halves 5 and 6 having a cross-section as seen in FIG. 3. Next each half sheet 5 and 6 is then folded lengthwise along lines $L_3$ and $L_4$, respectively, to form a "W" shaped cross-section as shown in FIGS. 4 and 5. It is preferred that the width $W_3$ of sheet 5 between lines $L_3$ and 4 be equal to the width $W_4$ of sheet 6 between lines $L_4$ and 4. In a more preferred embodiment the sum of these two widths $W_3$ and $W_4$ should at least equal container width $W_2$.

The folded sheet 1 is then compressed at each end and sealed at both ends by heat sealing or other conventional means. By sealing in this manner extra support and liner thickness is achieved at the ends of the liner 7. Since it is at this position that most pressure is applied during the transportation of the hazardous waste from container a liner of superior qualities has been produced.

Figure 7:
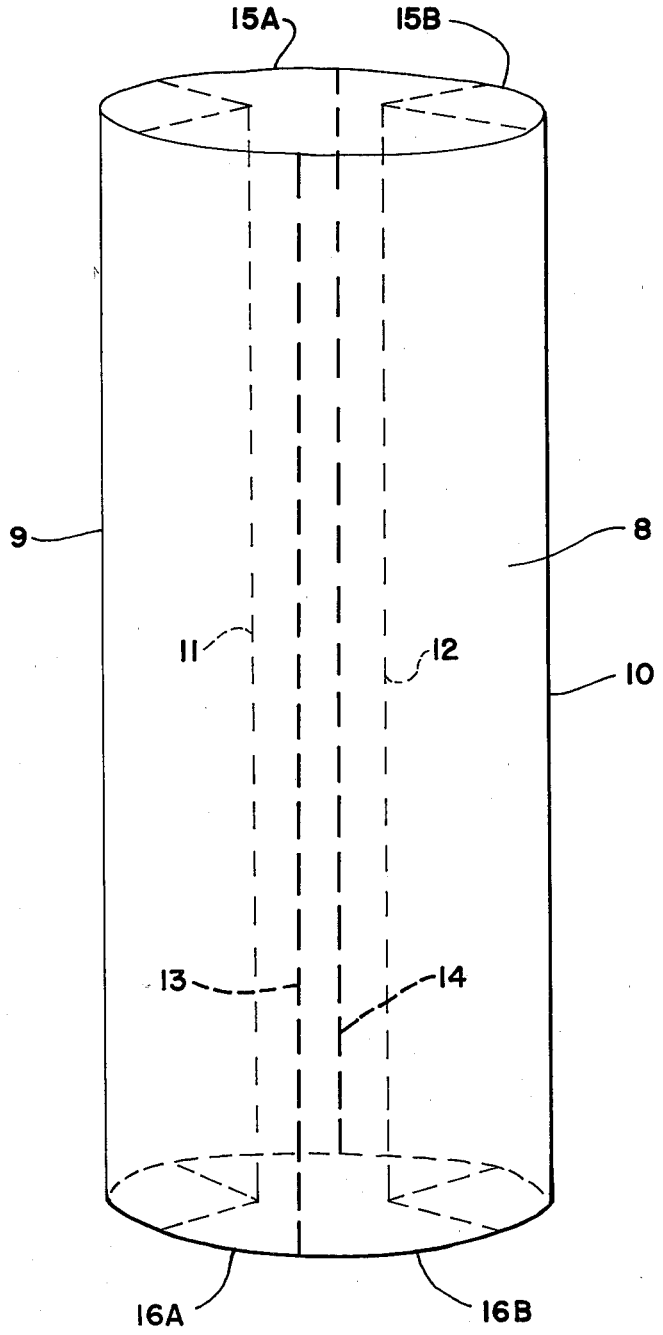
FIG. 7 is a perspective view of a preferred embodiment of the invention.

In a more preferred embodiment as shown in FIG. 7 a plastic envelope 8 is extruded to form a verticle tube up to 40 feet or longer in circumference. Envelope 8 is then folded inward along opposite center lines 9 and 10 of the two sheets to be formed to form opposed folds indicated by dotted lines 11 and 12, respectively. The folded envelope is then cut into two sections along a plane perpendicular to a plane formed by centerlines 9 and 10 and the opposed folds as indicated by dotted lines 13 and 14. Both sections are then heat sealed at their top 15*a* and 15*b*, respectively and bottom 16*a* and 16*b*, respectively, to form the desired liners.

There are, of course, many alternate preferred embodiments not specifically illustrated but which are intended to be included within the scope of this invention as defined by the following claims:

What I claim is:

1. A process for manufacturing a liner for use in a waste container, which comprises:

(a) folding along a lengthwise centerline of a sheet of material having a length longer than the length of said container to form two sections of said sheet;

(b) folding lengthwise each section of said sheet to form a "W" cross-section for said sheet; and, (c) sealing at opposite side ends of said sheet one section of said sheet to the other section of said sheet.

2. A process according to claim 1 wherein said sheet is constructed from a plastic material and wherein said sealing is heat sealing.

3. A process according to claim 1 wherein the combined width of both of said sections is at least equal to the width of said container.

4. A process according to claim 1 wherein a tubular cross-section of material is extruded and cut into two halves, each of said halves being one of the said sheets.

5. A process for manufacturing a plastic liner for use in a waste container, which comprises:

(a) extruding a plastic envelope of tubular cross-sectional cross-section;

(b) folding inward and lengthwise said envelope to form opposing folds;

(c) cutting said envelope lengthwise along a plane perpendicular to said opposing folds to form two "W" cross-sectional sheets; and (d) sealing opposite side ends of each of said sheets to form said liners.

* * * * *